US006794803B2

(12) United States Patent
Hori et al.

(10) Patent No.: US 6,794,803 B2
(45) Date of Patent: Sep. 21, 2004

(54) SPARK PLUG FOR AN INTERNAL COMBUSTION ENGINE

(75) Inventors: Tsunenobu Hori, Kariya (JP); Yasutake Ishino, Kariya (JP); Hironori Osamura, Chiryu (JP); Akira Mitsuhashi, Okegawa (JP); Mineo Okuma, Okegawa (JP)

(73) Assignee: Denso Corporation (JP)

( * ) Notice: Subject to any disclaimer, the term of this patent is extended or adjusted under 35 U.S.C. 154(b) by 136 days.

(21) Appl. No.: 10/097,143

(22) Filed: Mar. 14, 2002

(65) Prior Publication Data

US 2003/0038575 A1 Feb. 27, 2003

(30) Foreign Application Priority Data

Mar. 15, 2001 (JP) ..... 2001-074526
Mar. 1, 2002 (JP) ..... 2002-056477

(51) Int. Cl.[7] ..... H01T 13/20
(52) U.S. Cl. ..... 313/141
(58) Field of Search ..... 313/141, 144; 123/169 EL

(56) References Cited

U.S. PATENT DOCUMENTS

| | | | | |
|---|---|---|---|---|
| 4,329,174 A | | 5/1982 | Ito et al. | |
| 4,670,684 A | * | 6/1987 | Kagawa et al. | 313/141 |
| 4,853,582 A | * | 8/1989 | Sato et al. | 313/141 |
| 5,210,457 A | * | 5/1993 | Oshima et al. | 313/141 |
| 5,472,663 A | | 12/1995 | Kitamura et al. | |
| 6,208,066 B1 | * | 3/2001 | Kokubu et al. | 313/141 |
| 6,583,537 B1 | * | 6/2003 | Honda et al. | 313/141 |

FOREIGN PATENT DOCUMENTS

| | | |
|---|---|---|
| JP | 60-43897 | 10/1985 |
| JP | 2587864 | 12/1996 |

* cited by examiner

*Primary Examiner*—Ashok Patel
(74) *Attorney, Agent, or Firm*—Nixon & Vanderhye PC

(57) ABSTRACT

At least one of a center electrode and a ground electrode of an engine spark plug is a Ni-base alloy containing, in weight percentage, 0.5~2.5% Si, 0.1~1.2% Mn, 3.2~5.0% Al, 0.9~2.8% Cr, 0.001~0.025% C in addition to Ni and unavoidable impurities. And, a value S/V is in a range from 1.7 $mm^{-1}$ to 3.9 $mm^{-1}$ when 'S' represents a surface area of the ground electrode and 'V' represents a volume of the ground electrode.

17 Claims, 10 Drawing Sheets

SPARK PLUG FOR AN INTERNAL COMBUSTION ENGINE

BACKGROUND OF THE INVENTION

This invention relates to a spark plug employed in an internal combustion engine. More specifically, the present invention relates to an electrode material of a spark plug and its composition which satisfy required fundamental performances and can improve heat resistance, and therefore can be applied to a high-performance spark plug employed in a high-performance or high-advanced engine subjected to severe thermal load environment having not been experienced by conventional engines.

A spark plug conventionally employed in an internal combustion engine of an automotive vehicle, as understood with reference to FIG. 1, comprises a center electrode 30 fixed to an insulator 20 and a ground electrode 40 welded to 51 a metal housing 10. The metal housing 10 firmly surrounds an outer surface of insulator 20. The spark plug is securely fixed to an engine body via the metal housing 10. A distal end surface 41 of ground electrode 40 is opposed to an apical surface 31 of center electrode 30 so as to form a discharge gap 50. The discharge gap 50 causes a spark to ignite fuel gas mixture.

In this case, the material constituting an electrode material is required to satisfy sufficient high-temperature strength, anti-fusion property, high-temperature corrosion resistance, and spark exhaustion durability. For example, as preferable electrode material, U.S. Pat. No. 4,329,174 (corresponding to JP 60-43897) discloses a Ni-based alloy containing, in weight percentage (hereinafter, '%' represents 'weight %'), 0.2~3% Si, not larger than 0.5% Mn, and at least two kinds of additive components selected from the group consisting of 0.2~3% Cr, 0.2~3% Al, and 0.01~1% Y in addition to the main component Ni and unavoidable impurities.

However, recent internal combustion engines are required to operate at higher engine speeds. The recent combustion engines often use high-octane gasoline. These factors lead to the remarkable increase of combustion temperature in the combustion chamber. Accordingly, the spark plug electrode material, constituting the center electrode 30 and the ground electrode 40, is inevitably subjected to such high-temperature combustion atmosphere. The above-described conventional Ni-base alloy shows appropriate anti-fusion property, high-temperature corrosion resistance, and spark exhaustion durability in the high-temperature atmosphere. However, the above-described conventional Ni-base alloy is dissatisfactory in high-temperature strength. Thus, the life of the above-described conventional Ni-base alloy is relatively short.

To satisfy such requirements, Japanese Patent No. 2587864 discloses a Ni-base alloy containing Si, Mn, Cr and Al in addition to Ni, unavoidable impurities, and appropriate amount of rare earth elements. Adding the rare earth elements is effective to improve the high-temperature strength. More specifically, adding a very few amount of Ce, Nd, or La to an electrode material leads to remarkable improvement of high-temperature strength in a combustion atmosphere of 800° C., according to the disclosure of this patent.

However, the recent lean-burn combustion technique realized by a direct fuel injection system or the like necessitates many of the automotive manufactures to develop a high output/high performance and clean engine which is excellent in fuel consumption due to reduction of idling speed and is also capable of reducing the amount of $CO_2$ or other harmful emission gases. To realize such advanced engines, the recent spark plugs are required to have excellent heat resistance in a severer high-temperature combustion atmosphere, e.g., 950° C. or above at the ground electrode constituting the spark plug.

However, the excellent anti-fusion property, high-temperature corrosion resistance, and spark exhaustion durability of the above-described conventional electrode material is limited to the temperature level of approximately 800° C. If the above-described conventional electrode material is exposed to a severe combustion atmosphere exceeding 950° C., the ground electrode material will cause a damage accompanied by abnormal oxidation in the grain boundaries. The discharge gap will increase to a greater value (e.g., 1.2 mm) from its initial value (e.g., 0.8 mm). An increased amount of voltage will be required to ignite the spark plug. The spark plug may cause misfire in the worst case. In this manner, the above-described conventional electrode material will cause various problems when it is employed in a spark plug for an advanced high output/high performance engine.

SUMMARY OF THE INVENTION

In view of the above-described problems encountered in the prior art, the present invention has an object to provide a spark plug for an internal combustion engine which satisfies required fundamental performances of the spark plug electrode material and assures excellent heat resistance in a severe combustion atmosphere exceeding 950° C. which was not experienced by the conventional engine.

To accomplish the above and other related objects, the inventors of this application have worked on the research and development focused into the electrode materials which satisfy the required fundamental performances of an engine spark plug and have excellent heat resistance in a severer high-temperature combustion environment. As a result of research and development conducted by the inventors of this application, the optimized composition and size for an electrode material are experimentally found out. The present invention is derived from the experimental result.

The present invention provides a first spark plug for an internal combustion engine comprising an insulator, a center electrode fixed to a leg portion of the insulator which is exposed to a combustion chamber of an internal combustion engine, a metal housing firmly surrounding an outer surface of the insulator, and a ground electrode fixed to an end of the metal housing so as to form a spark discharge gap between the center electrode and the ground electrode.

The first spark plug of the present invention is characterized in that at least one of the center electrode and the ground electrode is a Ni-base alloy containing, in weight percentage, 0.5~2.5% Si, 0.1~1.2% Mn, 3.2~5.0% Al, 0.9~2.8% Cr, 0.001~0.025% C in addition to Ni and unavoidable impurities, and a value S/V is in a range from 1.7 $mm^{-1}$ to 3.9 $mm^{-1}$ when 'S' represents a surface area of the ground electrode and 'V' represents a volume of the ground electrode.

When the electrode material has the above-described composition, it becomes possible to provide a spark plug which satisfies the fundamental performances required for an internal combustion engine spark plug and assures reliable heat resistance even in a severe combustion atmosphere exceeding 950° C. in electrode temperature.

Furthermore, when the ratio S/V of the surface area 'S' to the volume 'V' of the ground electrode is in the range from 1.7 $mm^{-1}$ to 3.9 $mm^{-1}$, not only the heat resistance can be assured in the combustion atmosphere exceeding 950° C. in electrode temperature but also the bending work of the ground electrode can be facilitated. If the ratio S/V is less than 1.7 $mm^{-1}$, the bending work of the ground electrode for adjusting an initial discharge gap will become difficult. If the ratio S/V is larger than 3.9 $mm^{-1}$, the thermal conductivity of the ground electrode will be worsened and it will be difficult to obtain reliable heat resistance.

According to the present invention, it is preferable that at least one of the center electrode and the ground electrode is a Ni-base alloy containing, in weight percentage, 1.0~2.5% Si, 0.1~0.9% Mn, 3.5~5.0% Al, 1.3~2.5% Cr, 0.001~0.025% C in addition to Ni and unavoidable impurities.

When the electrode material has the above-described composition, it becomes possible to provide a spark plug which satisfies the fundamental performances required for an internal combustion engine spark plug and assures excellent heat resistance even in a severer combustion atmosphere exceeding 1,050° C. in electrode temperature.

Furthermore, according to the present invention, it is preferable that the ground electrode value S/V is in a range from 1.7 $mm^{-1}$ to 3.0 $mm^{-1}$. This is effective to assure excellent heat resistance in the severer combustion atmosphere exceeding 1,050° C. in electrode temperature. The bending work of the ground electrode can be further facilitated. The reason why the ground electrode value S/V is set in a range from 1.7 $mm^{-1}$ to 3.0 $mm^{-1}$ is substantially explained in the above description.

The present invention provides a second spark plug for an internal combustion engine comprising an insulator, a center electrode fixed to a leg portion of the insulator which is exposed to a combustion chamber of an internal combustion engine, a metal housing firmly surrounding an outer surface of the insulator, and a ground electrode fixed to an end of the metal housing so as to form a spark discharge gap between the center electrode and the ground electrode. The second spark plug of the present invention is characterized in that at least one of the center electrode and the ground electrode is constituted by a base material which forms a surficial aluminum oxide when it is left in an atmospheric environment at a temperature equal to or higher than 950° C. for a duration equal to or longer than 50 hours.

When the spark plug of this invention is used in the high-temperature environment exceeding 950° C., the surficial aluminum oxide is stably formed on the electrode base material. The surficial aluminum oxide effectively protects the inside portion of the electrode base material against oxidation. When a tip (i.e., a discharge member) is welded on the center electrode or the ground electrode serving as the electrode base material, the surficial aluminum oxide effectively protects the bonded boundary between the tip and the electrode base material against oxidation. Accordingly, the present invention provides an excellent spark plug which is capable of preventing the electrode base material from abnormally oxidizing, preventing the tip from falling off the electrode base material due to oxidation in the bonded boundary, and assuring long-lasting high performance, even in a very severe thermal load environment.

According to the present invention, it is preferable that the surficial aluminum oxide is stably formed as an oxide coating layer densely covering the electrode base material. Thus, the surficial aluminum oxide surely prevents the oxygen ions from diffusing inside the electrode base material. The effect of suppressing the oxidation is further enhanced.

According to the present invention, it is preferable that a portion of the ground electrode having not been subjected to bending deformation has a hardness Hv (0.5) equal to or less than 210 when the hardness is measured with a testing force of 4.903N according to a micro Vickers' hardness testing method regulated in JIS standard Z2244.

In general, adding Al in the electrode base material worsens the bending workability due to increase of hardness. However, when the hardness Hv (0.5) of the ground electrode is equal to or less than 210, it becomes possible to adequately suppress the springback into a practically allowable range when the ground electrode is subjected to bending deformation to form a discharge gap. Accordingly, the discharge gap can be accurately formed.

According to the present invention, the bending workability can be further improved. The accuracy in forming the discharge gap can be further improved.

Furthermore, according to the present invention, at least one of the center electrode and the ground electrode may serve as a base material. A tip, being made of a noble metal or its alloy, is fixed to a surface of the base material by welding.

When the noble metal tip serving as a discharge member is securely welded to the electrode base material, not only the spark exhaustion durability is greatly improved but also the bonding reliability of the noble metal tip welded to the electrode material can be greatly improved. For example, the electrode material preferably used in this case is a so-called NCF 600 (composition: Cr=15.5%, Fe=7%, C<0.15%, Mn<1%, Si<0.5%, and the remainder=Ni+unavoidable impurities). The composition of the present invention is different from composition of NCF 600. Having the composition defined by the present invention makes it possible to reduce the amount of Cr, thereby suppressing Cr from depositing into the bonded surface. Furthermore, adding Al according to the present invention is effective to protect the inside portion of the electrode base material against oxidation. This surely prevents generation of cracks caused by a thermal stress and also prevents oxidation of the bonded boundary. Accordingly, in a very severe thermal load environment, it is possible to assure appropriate heat resistance and also obtain excellent spark exhaustion durability and bonding reliability.

According to the present invention, it is preferable that the tip is made of a Pt alloy including not less than 50 weight % Pt as a chief component and at least one additive component selected from the group consisting of Ir, Rh, Ni, W, Pd, Ru, Os, Y, and $Y_2O_3$. On the other hand, according to the present invention, it is preferable that the tip is made of an Ir alloy including not less than 50 weight % Ir as a chief component and at least one additive component selected from the group consisting of Pt, Rh, Ni, W, Pd, Ru, Os, Y, and $Y_2O_3$.

When the tip is made of the above-described material, it becomes possible to improve the spark exhaustion durability. Even when the tip is used in an engine subjected to a large thermal load, it is possible to assure a satisfactory life of the spark plug.

According to the present invention, it is preferable that the ground electrode has a plated layer formed on a surface thereof.

In general, a spark plug may be left in a high-temperature and high-humid atmosphere before it is installed in an internal combustion engine. However, according to the spark plug of this invention, the plated layer formed on the surface of the ground electrode brings preferable functions and effects when the spark plug is installed in the internal combustion engine. Forming the plated layer on the ground electrode improves the appearance and the commercial value of a spark plug.

Like the above-described NCF 600, the electrode material having good heat resistance usually comprises a large amount of Cr and Fe additives and therefore tends to form a thick oxide film on the electrode surface. It is therefore difficult to assure satisfactory plating adhesion properties. The plated layer may peel off the electrode material, when the ground electrode is subjected to bending work. To solve this problem, it is generally necessary to apply a masking in the plating process. This increases the manufacturing costs and deteriorates the product quality in appearance.

On the other hand, the spark plug of the present invention having the composition of the present invention has a small amount of Cr and contains no Fe. Thus, the present invention brings satisfactory plating adhesion properties. The present invention provides a spark plug electrode material having preferable functions and effects durable in a very severe thermal load environment. Furthermore, the present invention brings the effects of reducing the manufacturing costs and improving the product quality in appearance.

The following is the reason why the present invention strictly defines the composition of a Ni-base alloy constituting the ground electrode of a spark plug. In the following explanation, all of the values expressed by '%' are the ones by the weight percent. A first aspect of the present invention defines an optimum range of the Ni-base alloy composition which is preferable for assuring the heat resistance in the combustion atmosphere exceeding 950°. A second aspect of the present invention defines an optimum range of the Ni-base alloy composition which is preferable for assuring the heat resistance in the combustion atmosphere exceeding 1,050°.

(a) Si

Si component has a function of improving the high-temperature corrosion resistance as well as the spark exhaustion durability. However, such preferable effects will not be satisfactorily obtained when the content of Si is less than 0.5%. On the other hand, when the content of Si exceeds 2.5%, working cracks may be produced in an electrode material during its manufacturing process. Accordingly, the present invention defines a range from 0.5 to 2.5% as a preferable content of Si (refer to the first aspect of the present invention). Furthermore, to assure the preferable effects of Si even in a further higher temperature combustion atmosphere, the present invention defines a range from 1.0 to 2.5% as a preferable content of Si (refer to the second aspect of the present invention).

(b) Mn

Mn component is an indispensable component due to its deoxidizing and desulfurizing functions required in the ingot process. However, such preferable functions will not be satisfactorily obtained when the content of Mn is less than 0.1%. On the other hand, when the content of Mn exceeds 1.2%, the high-temperature corrosion resistance will deteriorate greatly. Accordingly, the present invention defines a range from 0.1 to 1.2% as a preferable content of Mn (refer to the first aspect of the present invention). Furthermore, to assure the preferable effects of Mn even in a further higher temperature combustion atmosphere, the present invention defines a range from 0.1 to 0.9% as a preferable content of Mn (refer to the second aspect of the present invention).

(c) Al

Al component forms a dense oxide protective coating layer on an electrode surface when the electrode temperature exceeds 950° C. Al component has a function of suppressing the oxidation in the grain boundaries, thereby improving the high-temperature corrosion resistance and the high-temperature strength. However, such preferable functions will not be satisfactorily obtained when the content of Al is less than 3.2%. On the other hand, when the content of Al exceeds 5.0%, the workability will deteriorate. Accordingly, the present invention defines a range from 3.2 to 5.0% as a preferable content of Al (refer to the first aspect of the present invention). Furthermore, to assure the preferable effects of Al even in a further higher temperature combustion atmosphere, the present invention defines a range from 3.5 to 5.0% as a preferable content of Al (refer to the second aspect of the present invention).

(d) Cr

Cr component has a function of improving the high-temperature corrosion resistance. However, such preferable functions will not be satisfactorily obtained when the content of Cr is less than 0.9%. On the other hand, when the content of Cr exceeds 2.8%, the anti-fusion property will deteriorate. Accordingly, the present invention defines a range from 0.9 to 2.8% as a preferable content of Cr (refer to the first aspect of the present invention). Furthermore, to assure the preferable effects of Cr even in a further higher temperature combustion atmosphere, the present invention defines a range from 1.3 to 2.5% as a preferable content of Cr (refer to the second aspect of the present invention).

(e) C

C component has a deoxidizing function. Furthermore, C component forms a carbide which effectively suppresses excessive growth of crystal grains during the operation of the spark plug. Accordingly, adding the C component is appropriate if required. However, such preferable functions will not be satisfactorily obtained when the content of C is less than 0.001%. On the other hand, when the content of C exceeds 0.025%, the bending workability will deteriorate. Accordingly, the present invention defines a range from 0.001 to 0.025% as a preferable content of C.

BRIEF DESCRIPTION OF THE DRAWINGS

The above and other objects, features and advantages of the present invention will become more apparent from the following detailed description which is to be read in conjunction with the accompanying drawings, in which.

DESCRIPTION OF THE PREFERRED EMBODIMENTS

Figure 1:
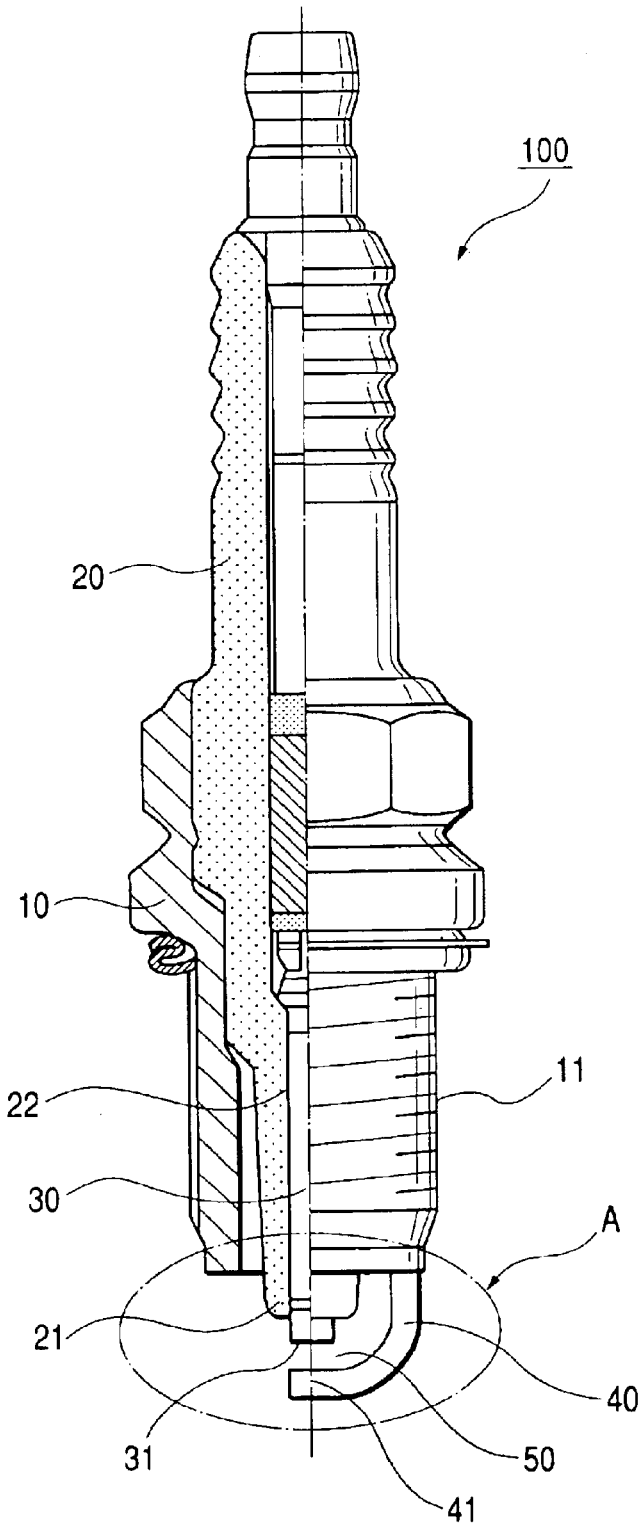
FIG. 1 is a half cross-sectional front view showing an overall arrangement of an engine spark plug in accordance with a preferred embodiment of the present invention.

Preferred embodiments of the present invention will be explained hereinafter with reference to attached drawings. Identical parts are denoted by the same reference numerals throughout the drawings.

Figure 2:
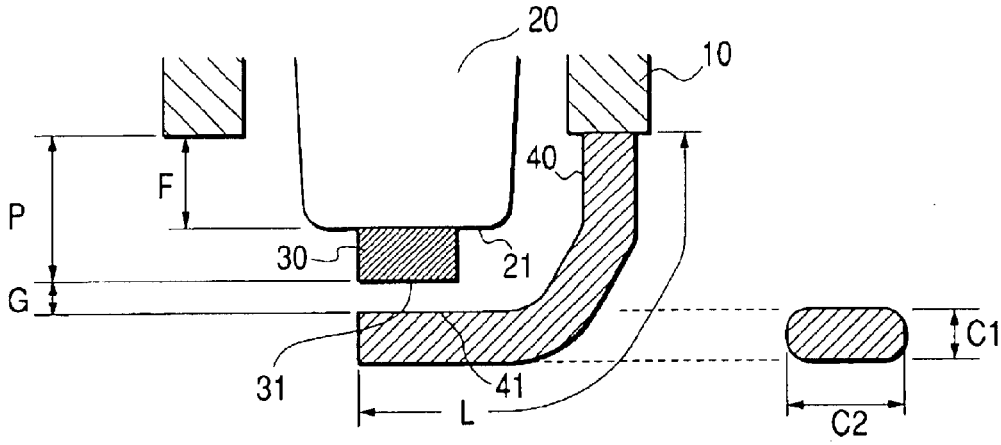
FIG. 2 is a cross-sectional view showing details of an encircled portion 'A' of the engine spark plug shown in FIG. 1.

A preferred embodiment of the present invention will be explained hereinafter with reference to FIGS. 1 and 2. FIG. 1 is a half cross-sectional front view showing an overall arrangement of a spark plug 100 in accordance with this embodiment of the present invention. FIG. 2 is an enlarged view showing an encircled portion 'A' of the spark plug 100 shown in FIG. 1. The spark plug 100 in accordance with the first embodiment is applicable to an ignition device of an automotive engine, such as a direct fuel injection engine, which is subjected to a very severe thermal load. The spark plug 100 is fixedly inserted into a screw hole opened in an engine block (not shown) which defines a combustion chamber of the engine.

The spark plug 100 has a cylindrical metallic housing 10 made of an electrically conductive steel member (e.g., low carbon steel). The metallic housing 10 has a threaded portion 11 for securely fixing the spark plug 100 to the engine block. The metallic housing 10 has an inside space for fixedly holding an insulator 20 made of an alumina ceramic ($Al_2O_3$) or the like. A front end 21 of insulator 20 protrudes out of the metallic housing 10.

The insulator 20 has an axial hole 22 for fixedly holding a center electrode 30. Thus, the center electrode 30 is held by the metallic housing 10 via the insulator 20. The center electrode 30 has a cylindrical body. As shown in FIG. 1, apical surface 31 of center electrode 30 protrudes out of the front end 21 of insulator 20. A ground electrode 40 has a proximal portion securely fixed to one end of metallic housing 10 by welding. The ground electrode 40 is bent at an intermediate portion. A distal end surface 41 of ground electrode 40 is opposed to the apical surface 31 of center electrode 30 so as to form a discharge gap 50 therebetween.

Each of the center electrode 30 and the ground electrode 40 is made of a Ni-base alloy. To check the heat resistance of the Ni-base alloy, various samples having different compositions were prepared. Table 1 shows representative samples thus prepared.

TABLE 1

| Classification | | Composition of Ni-base alloy (weight %) | | | | | | | ΔG (mm) | |
|---|---|---|---|---|---|---|---|---|---|---|
| | | Si | Mn | Al | Cr | Fe | C | Ni + impurities | 970° C. | 1070° C. |
| Inventive electrode material | EH1 | 0.5 | 1.2 | 3.2 | 0.9 | — | 0.008 | Remainder | 0.29 | 0.41 |
| | EH2 | 0.8 | 1.1 | 3.4 | 1.1 | — | 0.004 | Remainder | 0.27 | 0.38 |
| | EH3 | 1.0 | 0.9 | 3.5 | 1.2 | — | 0.009 | Remainder | 0.22 | 0.31 |
| | EH4 | 1.0 | 0.9 | 3.5 | 2.7 | — | 0.010 | Remainder | 0.20 | 0.31 |
| | EH5 | 0.8 | 0.9 | 3.5 | 1.3 | — | 0.011 | Remainder | 0.20 | 0.32 |
| | EH6 | 1.0 | 1.1 | 3.5 | 1.3 | — | 0.006 | Remainder | 0.21 | 0.31 |
| | EH7 | 1.0 | 0.9 | 3.3 | 1.3 | — | 0.006 | Remainder | 0.22 | 0.33 |
| | EH8 | 2.5 | 0.1 | 5.0 | 2.8 | — | 0.001 | Remainder | 0.11 | 0.22 |
| | EH9 | 1.0 | 0.9 | 3.5 | 1.3 | — | 0.004 | Remainder | 0.18 | 0.29 |
| | EH10 | 1.0 | 0.9 | 3.5 | 2.5 | — | 0.006 | Remainder | 0.17 | 0.29 |
| | EH11 | 2.5 | 0.1 | 5.0 | 2.5 | — | 0.024 | Remainder | 0.09 | 0.17 |
| | EH12 | 2.5 | 1.2 | 5.0 | 2.8 | — | 0.021 | Remainder | 0.12 | 0.25 |
| | EH13 | 2.5 | 0.9 | 5.0 | 2.5 | — | 0.025 | Remainder | 0.10 | 0.23 |
| | EH14 | 1.5 | 0.5 | 4.0 | 2.0 | — | 0.018 | Remainder | 0.14 | 0.26 |
| | EH15 | 1.2 | 0.2 | 4.8 | 1.4 | — | 0.012 | Remainder | 0.13 | 0.24 |
| | EH16 | 1.6 | 0.4 | 4.4 | 1.8 | — | 0.013 | Remainder | 0.14 | 0.25 |
| | EH17 | 1.9 | 0.6 | 4.1 | 2.1 | — | 0.018 | Remainder | 0.14 | 0.26 |
| | EH18 | 2.3 | 0.8 | 3.6 | 2.4 | — | 0.025 | Remainder | 0.15 | 0.27 |
| Conventional electrode material | EJ1 | 2.1 | 1.9 | 0.4 | 2.2 | — | 0.025 | Remainder | 0.53 | 0.88 |
| | EJ2 | 1.9 | 2.0 | 0.8 | 1.0 | — | — | Remainder | 0.58 | 0.90 |
| | EJ3 | 0.6 | 1.2 | — | 1.8 | — | — | Remainder | 0.68 | 0.96 |
| | EJ4 | 0.1 | 0.2 | — | 15.5 | 6.8 | 0.014 | Remainder | 0.33 | 0.42 |

P = 4.0 mm, F = 2.5 mm, G = 0.8 mm, and S/V = 2.21 $mm^{-12}$

An ordinary vacuum smelter was used to prepare a molten bath of each Ni-base alloy having the composition shown in FIG. 1. Then, a vacuum molding was performed to get an ingot of each Ni-base alloy. Then, a hot forging was applied to the ingot to form a round bar having a diameter of 10 mm. Subsequently, the round bar was cut or machined and/or subjected to a wire 10 drawing and a hot forging to obtain electrode material samples EH1 to EH18 in accordance with the present invention. Hereinafter, these samples EH1 to EH18 are referred to as inventive electrode materials which form the center electrode 30 and ground electrode 40 of the present inveniton. Similarly, conventional electrode material samples EJ1 to EJ4 were obtained. Hereinafter, these samples EJ1 to EJ4 are referred to as conventional electrode materials. As shown in FIG. 2, according to this embodiment, the center electrode 30 has a diameter of 2.5 mm and the ground electrode 40 has a thickness C1=1.4 mm and the width C2=2.6 mm which are ordinary sizes of an automotive vehicle spark plug. The cross-sectional configuration of ground electrode 40 is rectangular. The ground electrode 40 has a flat wide surface opposed to the center electrode 30. One side (i.e., the width C2 corresponding to the flat wide surface) of ground electrode 40 is longer than the other side (i.e., thickness C1) of ground electrode 40.

The test sample, i.e., each of the inventive electrode materials EH1 to EH18 and conventional electrode materials EJ1 to EJ4, was formed into the center electrode and the ground electrode which have ordinary sizes: ground electrode length L=10 m; spark position (i.e., protruding length of apical surface 31 of center electrode 30 protruding into the combustion chamber) P=4.0 mm; insulator protrusion (protruding length of the front end surface of insulator 20 relative to the edge of metal housing 10) F=2.5 mm; and discharge gap (i.e., shortest distance between electrodes) G=0.8 mm (initial value). In this case, the value S/V is set to 2.21 $mm^{-1}$.

Figure 3:
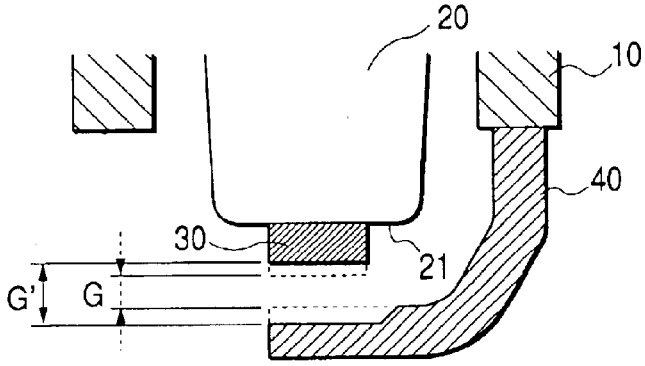
FIG. 3 is a cross-sectional view showing details of a measuring method of a discharge gap G' expanded through an endurance test in accordance with the present invention.

For the endurance test, the test spark plug was installed in a supercharged, 1,800 cc, gasoline engine which was driven at the engine rotational speed of 5,600 rpm for 120 hours at the air-fuel weight ratio (A/F) being set to 12.5. As shown in FIG. 3, the discharge gap of the tested spark plug was increased from its initial value G to an expanded value G' through the endurance test. The discharge gap G' was measured after the endurance test. The heat resistance was evaluated based on the measured discharge gap G'. In this endurance test, the temperature of ground electrode 40 was 970° C. at its distal end. According to the analysis of the inventors, when the discharge gap expansion ΔG (=G'−G) is equal to or less than 0.3 mm, the heat resistance is practically satisfactory even if the spark plug is used in a severe thermal load environment, such as a direct fuel injection engine.

First, as understood from Table 1, when the front end temperature of the ground electrode is 970° C., all of the tested inventive electrode materials EH1 to EH18 have demonstrated the capability of suppressing the discharge gap expansion ΔG into a level of 0.3 mm or less. On the other hand, all of the tested conventional electrode materials EJ1 to EJ4 could not suppress the discharge gap expansion ΔG to 0.3 mm. From this test result, it is apparent that the inventive electrode materials EH1 to EH18 have excellent heat resistance in a high-temperature environment exceeding 950° C. in electrode temperature.

In other words, when the conventional electrode materials EJ1 to EJ4 are used for the spark plug electrodes, the spark plug electrodes will be subjected to severe deterioration in the high-temperature environment exceeding 950° C. in electrode temperature. The discharge gap expansion ΔG becomes large compared with its initial value being set to 0.8 mm. This inevitably increases a requisite voltage applied to the spark plug electrodes. The inventors have researched the mechanism why the discharge gap of the conventional electrodes increases so greatly. Regarding the conventional electrode materials EJ1 to EJ3, the ground electrode material have suffered the damage caused by abnormal oxidation in the grain boundaries. This was the main reason why the discharge gap was increased so greatly. Regarding the remaining conventional electrode material EJ4 (NFC600), it has excellent high-temperature corrosion resistance.

However, the conventional electrode material EJ4 contains a very large amount of Cr. This reduces the thermal conductivity and lowers the melting point. Hence, the electrode temperature increases. The spark exhaustion durability and the anti-fusion property are worsened. This is the reason why the discharge gap is increased so greatly.

Accordingly, when the inventive electrode materials EH1 to EH18 are used for the spark plug electrodes, it becomes possible to provide a spark plug 100 capable of assuring excellent heat resistance in a severe high-temperature environment exceeding 950° C. The inventive electrode materials EH1 to EH18 are made of the Ni-base alloy having the composition, in weight %, 0.5~2.5% Si, 0.1~1.2% Mn, 3.2~5.0% Al, 0.9~2.8% Cr, 0.001~0.025% C in addition to Ni and unavoidable impurities.

Next, the inventors have evaluated the heat resistance in a further higher temperature environment. To this end, the ignition timing was advanced to increase the front end temperature of the ground electrode to 1,070° C. Each tested spark plug for this evaluation has the same configuration as that of the above-described tested spark plug. The endurance test for this evaluation was conducted under the same conditions as those of the above-described endurance test. The discharge gap G' was measured after the endurance test. The heat resistance was evaluated based on the measured discharge gap G'. As understood from Table 1, when the front end temperature of the ground electrode is 1,070° C., the tested inventive electrode materials EH8 to EH18 have demonstrated the capability of suppressing the discharge gap expansion ΔG into a level of 0.3 mm or less. On the other hand, the tested inventive electrode materials EH1 to EH7 could not suppress the discharge gap expansion ΔG to 0.3 mm although their discharge gap expansion ΔG was smaller than those of the conventional electrode materials EJ1 to EJ4. Due to increase of the electrode temperature, it is believed that the high-temperature corrosion resistance, the anti-fusion property, and the spark exhaustion durability are worsened. Needless to say, the conventional electrode materials EJ1 to EJ4 have suffered large expansion of the discharge gap due to the above-described reasons (i.e., abnormal oxidation in the grain boundaries) explained in the case the front end temperature of the ground electrode is 970° C.

Accordingly, when the inventive electrode materials EH8 to EH18 are used for the spark plug electrodes, it becomes possible to provide a spark plug 100 capable of assuring excellent heat resistance in a severe high-temperature environment exceeding 1,050° C. The inventive electrode materials EH8 to EH18 are made of the Ni-base alloy having the composition, in weight %, 1.0~2.5% Si, 0.1~0.9% Mn, 3.5~5.0% Al, 1.3~2.5% Cr, 0.001~0.025% C in addition to Ni and unavoidable impurities.

Furthermore, as shown Table 2, the inventors have evaluated the bending wokability and heat resistance for a plurality of electrode samples whose S/V values are variously differentiated. In Table 2, 'C1' and 'C2' are used to express the size of the cross section of the ground electrode, where 'C1' represents the thickness and 'C2' represents the width. In Table 2, 'S' represents a surface area of the ground electrode and 'V' represents a volume of the ground electrode.

Figure 4:
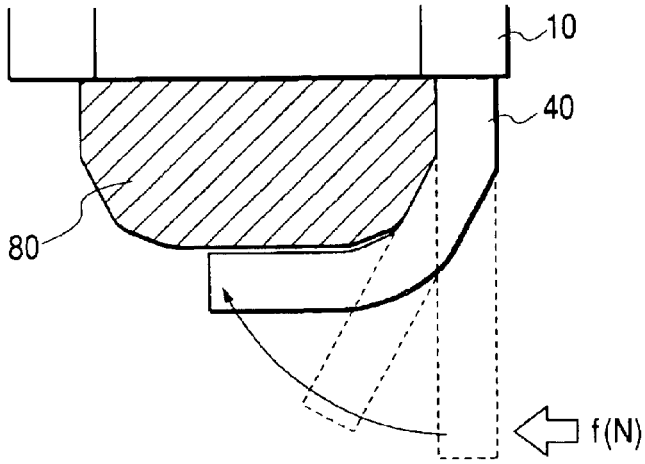
FIG. 4 is a cross-sectional view showing details of a measuring method of bending workability of a ground electrode in accordance with the present invention.

The bending workability of the ground electrode was evaluated by measuring a bending force 'f' required for bending the ground electrode into a substantially L-shaped configuration. FIG. 4 shows a bending jig 80 used for bending the ground electrode into a substantially L-shaped configuration. The bending workability was evaluated based on the measured bending force 'f'.

According to the analysis of the inventors, when the bending force 'f' is equal to or less than 750 N, the bending work is easy and accordingly it becomes possible to assure satisfactory bending workability. The heat resistance was evaluated based on the spark plug G' measured after the endurance test. The endurance test was conducted under the same conditions as those of the above-described endurance test. The configuration of the tested spark plug is identical with that of the above-described one except for the setting of S/V value.

TABLE 2

| Ground electrode thickness C1 | Ground electrode width C2 | S/V (S: ground electrode surface area, V: ground electrode volume) |
|---|---|---|
| 0.6 | 1.4 | 4.77 |
| 0.7 | 1.5 | 4.20 |
| 0.8 | 1.6 | 3.76 |
| 0.8 | 2.0 | 3.51 |
| 1.0 | 2.2 | 2.92 |
| 1.2 | 2.5 | 2.48 |
| 1.4 | 2.6 | 2.21 |
| 1.6 | 2.8 | 1.97 |
| 1.6 | 3.3 | 1.87 |
| 1.7 | 3.5 | 1.76 |
| 1.8 | 3.6 | 1.68 |
| 2.0 | 4.0 | 1.51 |

L = 10 mm, P = 4.0 mm, F = 2.5 mm, and G = 0.8 mm

Figure 5:
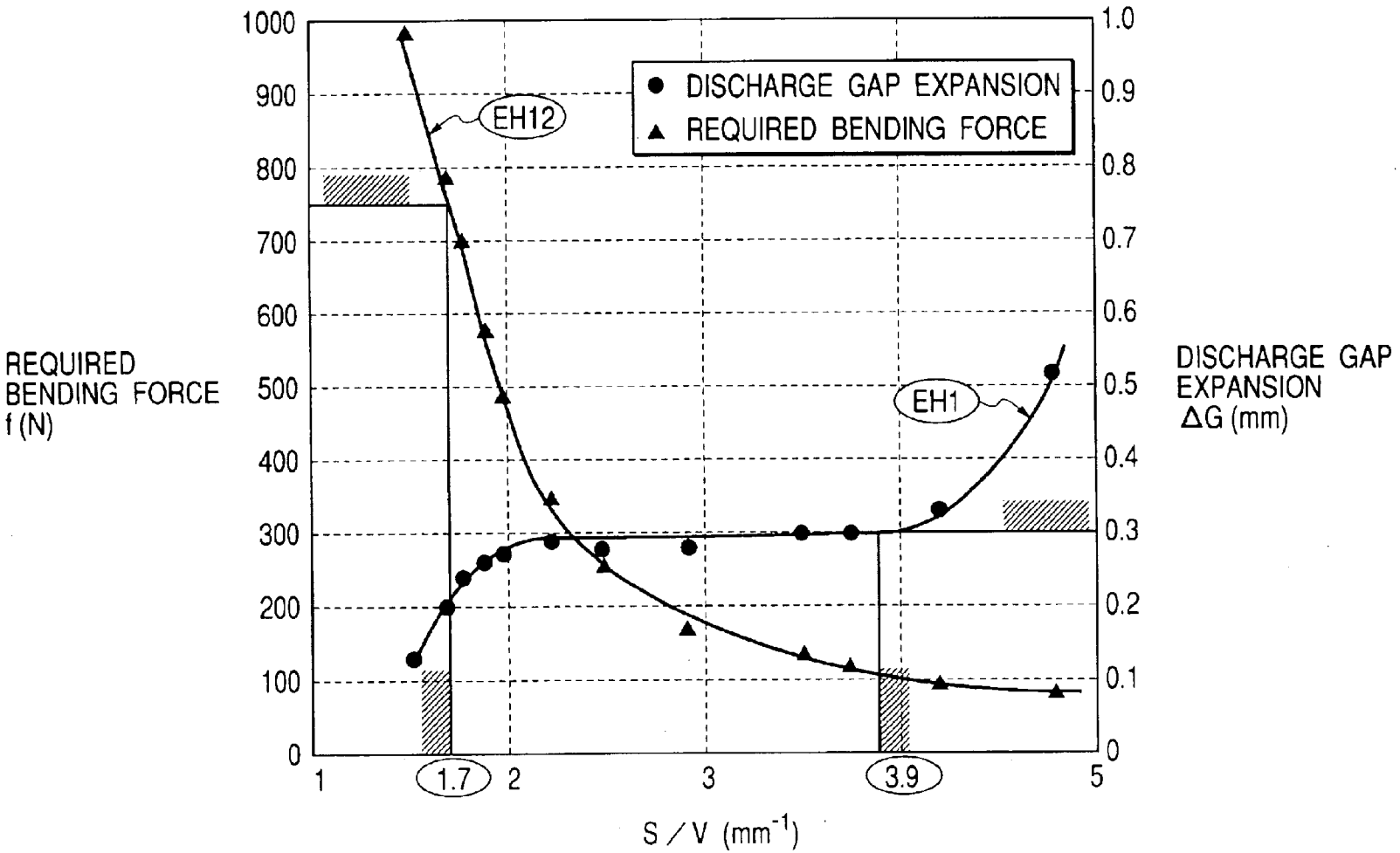
FIG. 5 is a graph showing a relationship between a bending force 'f' required in the bending work (left ordinate) and a discharge gap expansion ΔG (right ordinate) relative to S/V (abscissa) with respect to inventive electrode materials EH12 and EH1.

FIG. 5 is a graph showing a relationship between the bending force 'f' required in the bending work (left ordinate) and the discharge gap expansion ΔG (right ordinate) relative to S/V (abscissa). The bending workability was evaluated based on the inventive electrode material EH12 (which is the hardest material to bend among the inventive electrode materials having the composition defined in the first aspect of the present invention). The heat resistance was evaluated based on the inventive electrode material EH1 (which has the largest discharge gap expansion ΔG among the inventive electrode materials having the composition defined in the first aspect of the present invention). In this heat resistance evaluation, the front end temperature of the ground electrode was set to 970° C. and the S/V value was 2.21 $mm^{-1}$ (corresponding to an ordinary automotive spark plug size: C1=1.4 mm, C2=2.6 mm).

As understood from FIG. 5, when S/V is equal to or larger than 1.7 $mm^{-1}$, the required bending force 'f' can be suppressed to 750 N or less. When S/V is equal to or less than 3.9 $mm^{-1}$, the discharge gap expansion ΔG can be suppressed into a level of 0.3 mm or less.

In other words, the present invention defines the conditions for assuring excellent heat resistance in a high-temperature environment exceeding 950° C. in electrode temperature and obtaining satisfactory bending workability of the ground electrode. More specifically, the conditions defined by the present invention are that the spark plug electrodes are made of the N-base alloy containing, in weight percentage, 0.5~2.5% Si, 0.1~1.2% Mn, 3.2~5.0% Al, 0.9~2.8% Cr, 0.001~0.025% C in addition to Ni and unavoidable impurities, and the value S/V is in a range from 1.7 $mm^{-1}$ to 3.9 $mm^{-1}$.

Figure 6:
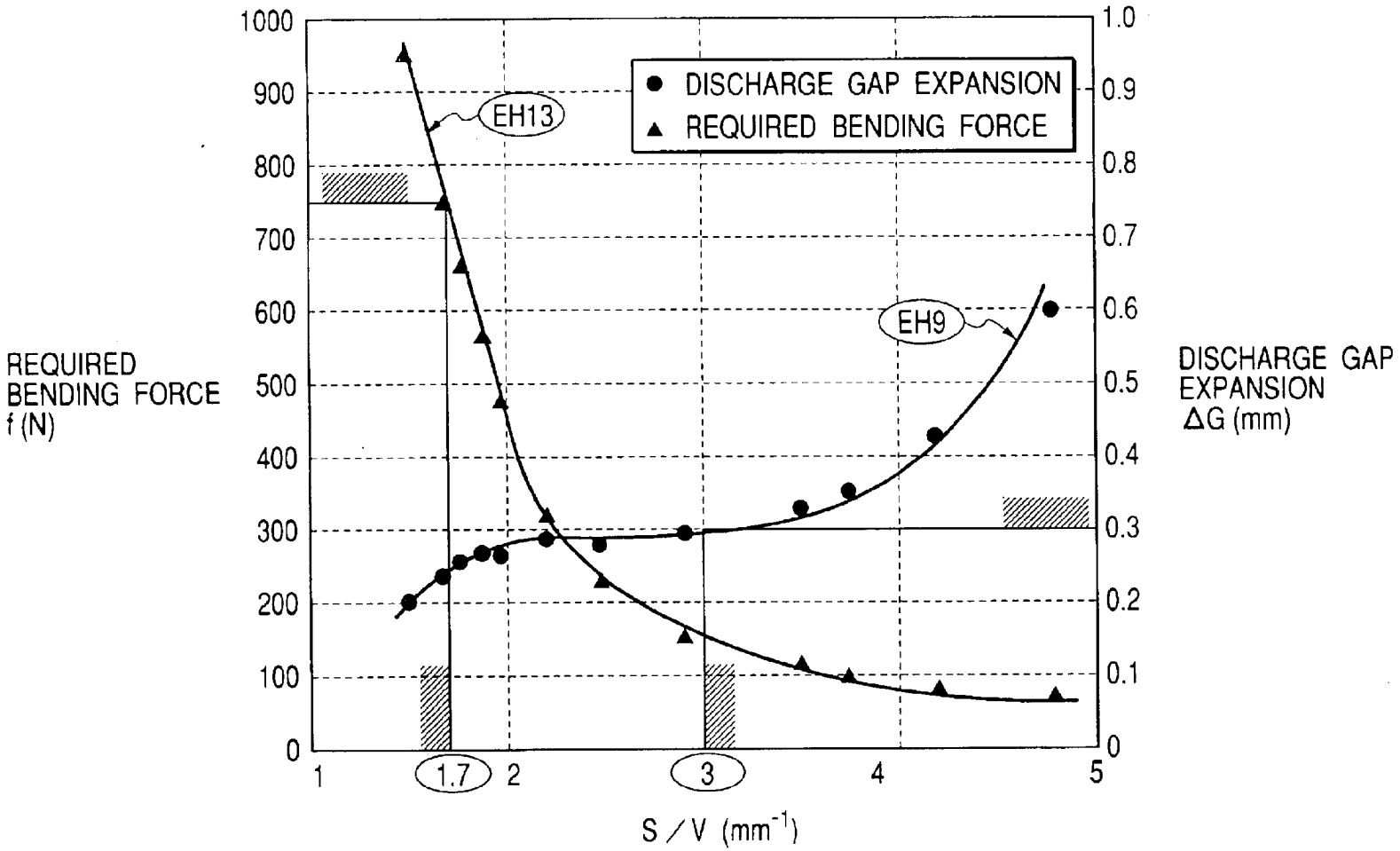
FIG. 6 is a graph showing a relationship between the bending force 'f' required in the bending work (left ordinate) and the discharge gap expansion ΔG (right ordinate) relative to S/V (abscissa) with respect to inventive electrode materials EH13 and EH9.

In the same manner, the bending workability was evaluated based on the inventive electrode material EH13 (which is the hardest material to bend among the inventive electrode materials having the composition defined in the second aspect of the present invention). The heat resistance was evaluated based on the inventive electrode material EH9 (which has the largest discharge gap expansion ΔG among the inventive electrode materials having the composition defined in the second aspect of the present invention). In this heat resistance evaluation, the front end temperature of the ground electrode was set to 1,070° C. and the S/V value was 2.21 $mm^{-1}$ (corresponding to an ordinary automotive spark plug size: C1=1.4 mm, C2=2.6 mm). FIG. 6 is a graph showing the evaluation result, wherein the abscissa represents S/V, the left ordinate represents the bending force 'f' required in the bending work, and the right ordinate represents the discharge gap expansion ΔG.

As understood from FIG. 6, when S/V is equal to or larger than 1.7 $mm^{-1}$, the required bending force 'f' can be suppressed to 750 N or less. When S/V is equal to or less than 3.0 $mm^{-1}$, the discharge gap expansion ΔG can be suppressed to 0.3 mm or less.

In other words, the present invention defines the conditions for assuring excellent heat resistance in an extremely high-temperature environment exceeding 1,050° C. in electrode temperature and obtaining satisfactory bending workability of the ground electrode. More specifically, the conditions defined by the present invention are that the spark plug electrodes are made of the N-base alloy containing, in weight percentage, 1.0~2.5% Si, 0.1~0.9% Mn, 3.5~5.0% Al, 1.3~2.5% Cr, 0.001~0.025% C in addition to Ni and unavoidable impurities, and the value S/V is in a range from 1.7 $mm^{-1}$ to 3.0 $mm^{-1}$.

According to this embodiment, a portion of the ground electrode having not been subjected to bending deformation has a hardness Hv (0.5) equal to or less than 210. Preferably, the hardness Hv (0.5) is equal to or less than 190. In this case, the hardness Hv (0.5) is measured with a testing force of 4.903N according to a micro Vickers' hardness testing method regulated in JIS standard Z2244. The portion having not been subjected to bending deformation accurately reflects the workability because the hardness is not changed before and after the bending work.

Figure 7:
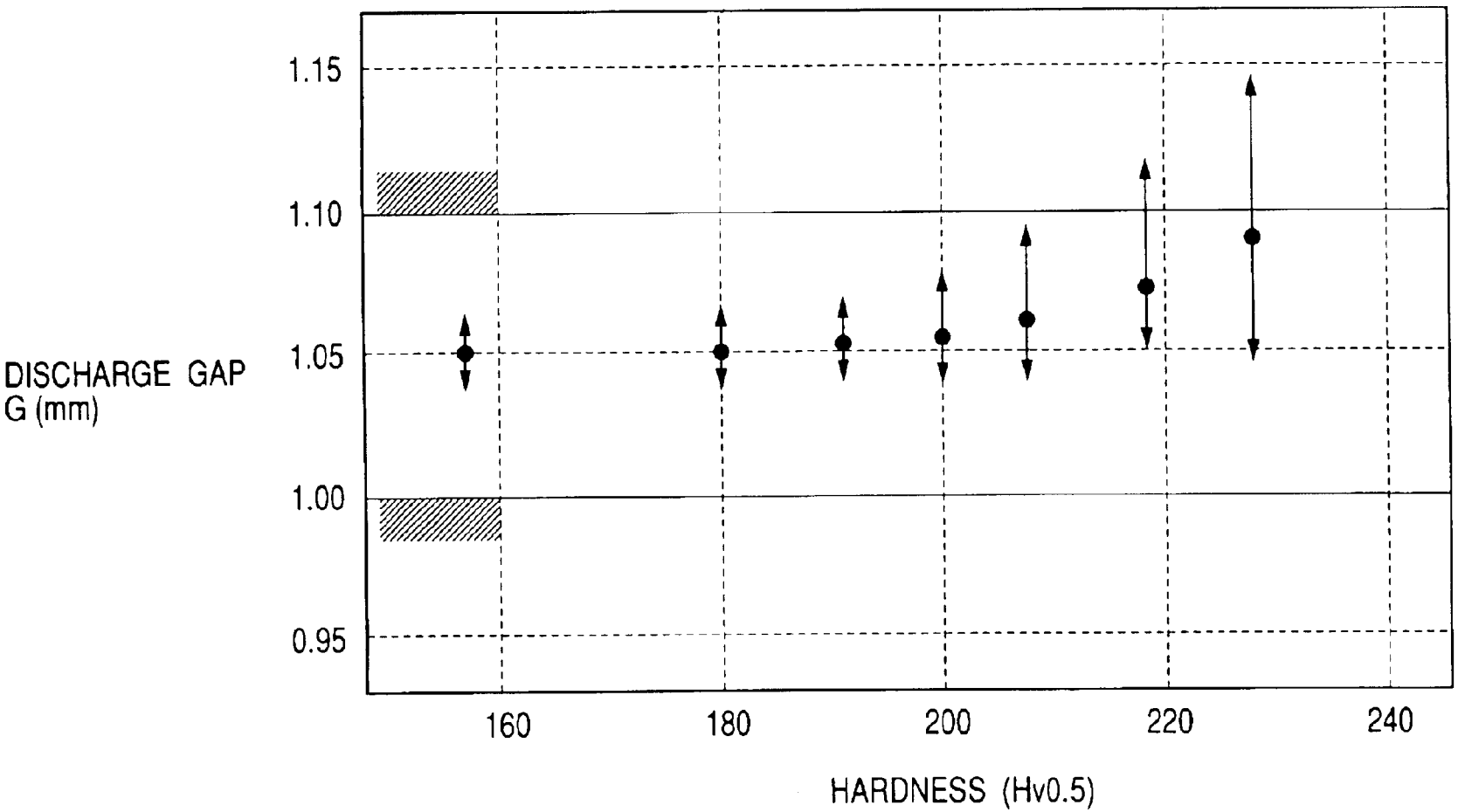
FIG. 7 is a graph showing a dispersion of discharge gap with respect to the hardness of a ground electrode.

FIG. 7 is a graph showing the dispersion of discharge gap G with respect to the hardness of the ground electrode. The evaluation was done based on the inventive electrode material EH12 (S/V=1.76) which is the hardest material to bend among the inventive electrode materials. This electrode material was subjected to a thermal treatment (annealing and solution treatment) to decrease the hardness into the above-described range. As understood from FIG. 7, the dispersion of discharge gap G increases with increasing hardness of the ground electrode. In FIG. 7, the dispersion is expressed by an up-and-down width of each arrow. A deviation (indicated by a black circle) of each arrow with respect to the center value of the discharge gap (gap=1.05) increases with increasing dispersion of discharge gap. In other words, the accuracy of discharge gap size becomes worse.

On the other hand, when the hardness Hv(0.5) of the ground electrode is equal to or smaller than 210, the workability is improved. The dispersion of discharge gap is small. The deviation from the center value is small. Accordingly, the discharge gap can be accurately formed. When the hardness Hv(0.5) of the ground electrode is equal to or smaller than 190, the above-described effects can be further enhanced.

Figure 8A:
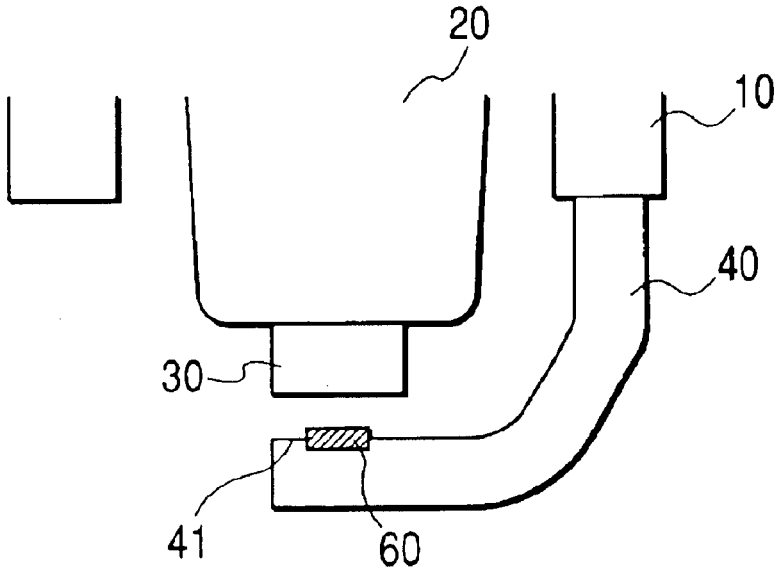
FIGS. 8A and 8B are typical cross-sectional views each showing an essential arrangement of a spark plug for an internal combustion engine in accordance with another embodiment of the present invention.
Figure 8B:
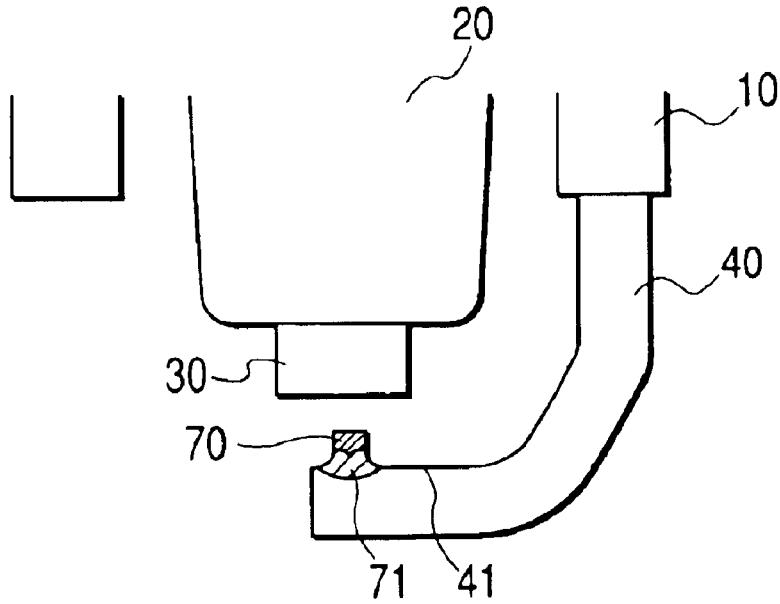

Hereinafter, a second embodiment of the present invention will be explained with reference to FIGS. 8A and 8B which show an essential portion of a spark plug in accordance with the second embodiment of the present invention. FIG. 8A shows a tip 60 fixed to the distal end surface 41 of ground electrode 40 by resistance welding. FIG. 8B shows a tip 70 fixed to the distal end surface 41 of ground electrode 40 via a fused portion 71 by laser welding.

Although the tip of this embodiment is not limited to a specific component, the tip 60 is made of 78Pt-201r-2Ni (i.e., 78 weight % Pt, 20 weight % Ir, and 2 weight % Ni). The tip 60 has a disk shape having the diameter of 1.0 mm and the thickness of 0.3 mm. The tip 70 is made of 90Ir-10Rh (i.e., 90 weight % Ir, and 10 weight % Rh). The tip 70 has a columnar shape having the diameter of 0.7 mm and the thickness of 0.85 mm. These sizes of tips 60 and 70 are ordinary sizes for the automotive spark plug.

The inventors have evaluated the bonding reliability of tips 60 and 70 of FIGS. 8A and 8B which are bonded to the ground electrode 40 made of each of the inventive electrode materials EH1 to EH18 and the conventional electrode materials EJ1 to EJ4. To check the endurance of the spark plug, the engine tests were conducted on a 2,000 cc engine to perform 100 hours temperature cycle test consisting of 1-minute fully throttle opened operation (at the engine speed of 6,000 rpm) and 1-minute idling operation. The configuration of each tested spark plug was ground electrode length L=10 m, spark position P=4.0 mm, insulator protrusion F=2.5 mm, and discharge gap G=0.8 mm (initial value). The S/V value was set to 2.21 $mm^{-1}$ (C1=1.4 mm, C2=2.6 mm). The front end temperature of ground electrode 40 was 1,070° C.

Figure 9A:
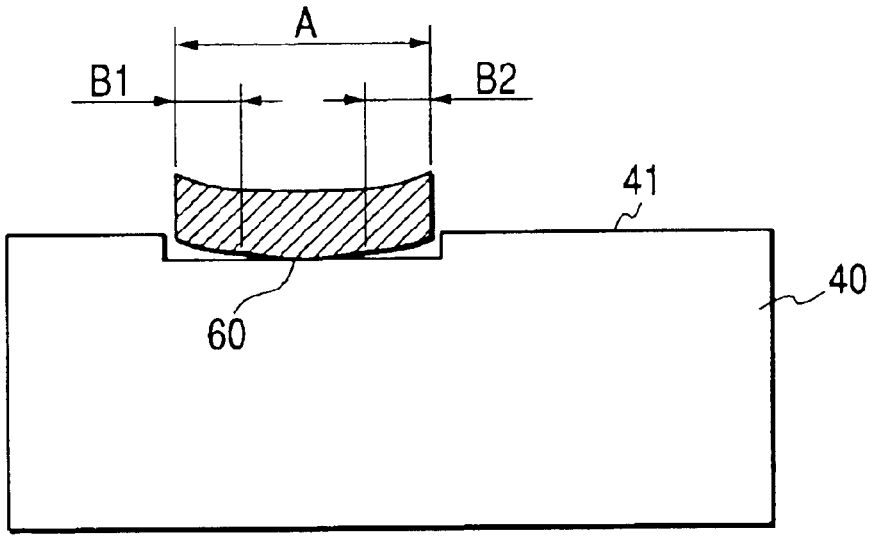
FIGS. 9A and 9B are typical cross-sectional views each explaining an evaluation method of a peel rate introduced in a bonding reliability test in accordance with the present invention.
Figure 9B:
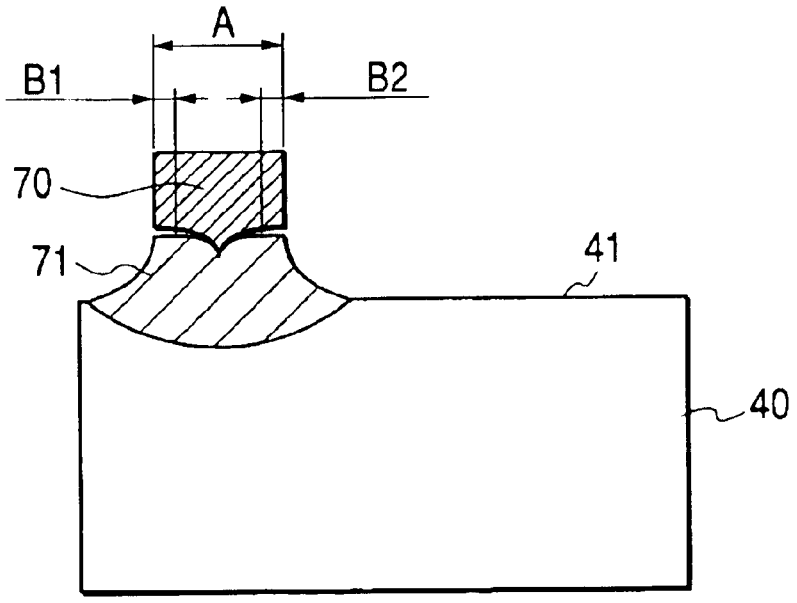

The bonding reliability was evaluated based on a peel rate. FIGS. 9A and 9B are typical cross-sectional views each explaining an evaluation method of the peel rate introduced in the bonding reliability test of the present invention. In the case of FIG. 9A, the peel rate is defined by 100×(B1+B2)/A (%), where 'A' represents an initial length of a joint surface between the tip 60 and the ground electrode 40 and 'B1+B2' represents a total peel length between the tip 60 and the ground electrode 40 found after the engine test. In the same manner, in the case of FIG. 9B, the peel rate is defined by 100×(B1+B2)/A (%), although 'A' represents the initial length of a joint surface between the tip 70 and the fused portion 71 and 'B1+B2' represents a total peel length between the tip 70 and the fused portion 71 found after the engine test.

According to the analysis of the inventors, the spark plug can be used in a severe thermal load environment, such as in a direct fuel injection engine, if the peel rate can be suppressed to 25% or less even after the endurance test. The bonding reliability is practically acceptable. Table 3 shows the result of evaluation according to this judgement.

As understood from Table 3, the compositions of the inventive electrode materials EH1 to EH18 are effective to suppress the peel rate to 25% or less. On the other hand, the compositions of conventional electrode materials EJ1 to EJ4 could not suppress the peel rate to 25% or less. In this manner, it is confirmed that the inventive electrode materials EH1 to EH18 have excellent bonding reliability compared with the conventional electrode materials EJ1 to EJ4.

Accordingly, when the spark plug electrode material has the composition defined by the first or second aspect of the present invention, it becomes possible to provide a spark plug 100 which assures satisfactory heat resistance and excellent spark exhaustion durability and the bonding reliability even in a severe thermal load environment, such as in a direct fuel injection engine.

Table 3

| Classification | | Composition of Ni-base alloy (weight %) | | | | | | | Peel rate (%) | |
|---|---|---|---|---|---|---|---|---|---|---|
| | | Si | Mn | Al | Cr | Fe | C | Ni + impurities | Resistance welding | Laser welding |
| Inventive electrode material | EH1 | 0.5 | 1.2 | 3.2 | 0.9 | — | 0.008 | Remainder | 24 | 20 |
| | EH2 | 0.8 | 1.1 | 3.4 | 1.1 | — | 0.004 | Remainder | 22 | 19 |
| | EH3 | 1.0 | 0.9 | 3.5 | 1.2 | — | 0.009 | Remainder | 19 | 15 |
| | EH4 | 1.0 | 0.9 | 3.5 | 2.7 | — | 0.010 | Remainder | 18 | 14 |
| | EH5 | 0.8 | 0.9 | 3.5 | 1.3 | — | 0.011 | Remainder | 20 | 17 |
| | EH6 | 1.0 | 1.1 | 3.5 | 1.3 | — | 0.006 | Remainder | 20 | 13 |
| | EH7 | 1.0 | 0.9 | 3.3 | 1.3 | — | 0.006 | Remainder | 22 | 17 |
| | EH8 | 2.5 | 0.1 | 5.0 | 2.8 | — | 0.001 | Remainder | 12 | 9 |
| | EH9 | 1.0 | 0.9 | 3.5 | 1.3 | — | 0.004 | Remainder | 16 | 11 |
| | EH10 | 1.0 | 0.9 | 3.5 | 2.5 | — | 0.006 | Remainder | 18 | 12 |
| | EH11 | 2.5 | 0.1 | 5.0 | 2.5 | — | 0.024 | Remainder | 5 | 3 |
| | EH12 | 2.5 | 1.2 | 5.0 | 2.8 | — | 0.021 | Remainder | 11 | 8 |
| | EH13 | 2.5 | 0.9 | 5.0 | 2.5 | — | 0.025 | Remainder | 10 | 9 |
| | EH14 | 1.5 | 0.5 | 4.0 | 2.0 | — | 0.018 | Remainder | 15 | 11 |
| | EH15 | 1.2 | 0.2 | 4.8 | 1.4 | — | 0.012 | Remainder | 15 | 9 |
| | EH16 | 1.6 | 0.4 | 4.4 | 1.8 | — | 0.013 | Remainder | 13 | 10 |
| | EH17 | 1.9 | 0.6 | 4.1 | 2.1 | — | 0.018 | Remainder | 18 | 13 |
| | EH18 | 2.3 | 0.8 | 3.6 | 2.4 | — | 0.025 | Remainder | 16 | 14 |
| Conventional electrode material | EJ1 | 2.1 | 1.9 | 0.4 | 2.2 | — | 0.025 | Remainder | 67 | 57 |
| | EJ2 | 1.9 | 2.0 | 0.8 | 1.0 | — | — | Remainder | 62 | 55 |
| | EJ3 | 0.6 | 1.2 | — | 1.8 | — | — | Remainder | 70 | 64 |
| | EJ4 | 0.1 | 0.2 | — | 15.5 | 6.8 | 0.014 | Remainder | 35 | 30 |

P = 4.0 mm, F = 2.5 mm, G = 0.8 mm, S/V = 2.21 $mm^{-1}$, and L = 10 mm

Next, a third embodiment of the present invention will be explained. The inventors have conducted ordinary peel strength tests of plating which are known as an evaluation method for the ground electrode material of a spark plug. As shown in Table 4, the adhesive properties of a plating applied on each of the inventive electrode materials EH1 to EH18 and the conventional electrode materials EJ1 to EJ4 was evaluated from two different standpoints.

First, to confirm the presence of any peel of plating caused by a bending force applied on the ground electrode for forming the discharge gap, the inventors have performed repetitive bending tests according to which the bending operation shown in FIG. 4 was repeated three times to check the presence of any peel of plating at a bent portion.

Second, to confirm the presence of any peel of plating caused by a thermal stress applied on the ground electrode, the inventors have performed quenching tests according to which the tested electrode materials were left in a constant temperature furnace of 300° C. for one hour and subsequently cooled rapidly in water to check the presence of any peel of plating. In Table 4, each electrode material indicated by ○ has no peel of plating after the quenching test. Each electrode material indicated by × has peel of plating after the quenching test. According to the analysis of the inventors, the electrode materials having caused no peel of plating through the above-described two kinds of peel strength tests is practically satisfactory in their plating adhesive properties.

TABLE 4

| Classification | | Composition of Ni-base alloy (weight %) | | | | | | | Plating adhesive properties | |
|---|---|---|---|---|---|---|---|---|---|---|
| | | Si | Mn | Al | Cr | Fe | C | Ni + impurities | Bending | Quenching |
| Inventive electrode material | EH1 | 0.5 | 1.2 | 3.2 | 0.9 | — | 0.008 | Remainder | ○ | ○ |
| | EH2 | 0.8 | 1.1 | 3.4 | 1.1 | — | 0.004 | Remainder | ○ | ○ |
| | EH3 | 1.0 | 0.9 | 3.5 | 1.2 | — | 0.009 | Remainder | ○ | ○ |
| | EH4 | 1.0 | 0.9 | 3.5 | 2.7 | — | 0.010 | Remainder | ○ | ○ |
| | EH5 | 0.8 | 0.9 | 3.5 | 1.3 | — | 0.011 | Remainder | ○ | ○ |
| | EH6 | 1.0 | 1.1 | 3.5 | 1.3 | — | 0.006 | Remainder | ○ | ○ |
| | EH7 | 1.0 | 0.9 | 3.3 | 1.3 | — | 0.006 | Remainder | ○ | ○ |
| | EH8 | 2.5 | 0.1 | 5.0 | 2.8 | — | 0.001 | Remainder | ○ | ○ |
| | EH9 | 1.0 | 0.9 | 3.5 | 1.3 | — | 0.004 | Remainder | ○ | ○ |
| | EH10 | 1.0 | 0.9 | 3.5 | 2.5 | — | 0.006 | Remainder | ○ | ○ |
| | EH11 | 2.5 | 0.1 | 5.0 | 2.5 | — | 0.024 | Remainder | ○ | ○ |
| | EH12 | 2.5 | 1.2 | 5.0 | 2.8 | — | 0.021 | Remainder | ○ | ○ |
| | EH13 | 2.5 | 0.9 | 5.0 | 2.5 | — | 0.025 | Remainder | ○ | ○ |
| | EH14 | 1.5 | 0.5 | 4.0 | 2.0 | — | 0.018 | Remainder | ○ | ○ |
| | EH15 | 1.2 | 0.2 | 4.8 | 1.4 | — | 0.012 | Remainder | ○ | ○ |
| | EH16 | 1.6 | 0.4 | 4.4 | 1.8 | — | 0.013 | Remainder | ○ | ○ |
| | EH17 | 1.9 | 0.6 | 4.1 | 2.1 | — | 0.018 | Remainder | ○ | ○ |
| | EH18 | 2.3 | 0.8 | 3.6 | 2.4 | — | 0.025 | Remainder | ○ | ○ |
| Conventional electrode material | EJ1 | 2.1 | 1.9 | 0.4 | 2.2 | — | 0.025 | Remainder | ○ | ○ |
| | EJ2 | 1.9 | 2.0 | 0.8 | 1.0 | — | — | Remainder | ○ | ○ |
| | EJ3 | 0.6 | 1.2 | — | 1.8 | — | — | Remainder | ○ | ○ |
| | EJ4 | 0.1 | 0.2 | — | 15.5 | 6.8 | 0.014 | Remainder | X | X |

○ = no peel of plating found, X = peel of plating found

As understood from Table 4, all of the inventive electrode materials EH1 to EH18 and the conventional electrode materials EJ1 to EJ3 satisfy the required plating adhesive properties. The conventional electrode materials EJ4 could not satisfy the required plating adhesive properties. In other words, the inventive electrode materials EH1 to EH18 have excellent plating adhesive properties compared with the conventional electrode materials EJ4 (NCF600).

Accordingly, when the spark plug electrode material has the composition defined by the first or second aspect of the present invention, it becomes possible to provide a spark plug 100 which assures satisfactory heat resistance and excellent plating adhesive properties even in a severe thermal load environment, such as in a direct fuel injection engine.

As explained above, the spark plug of an internal combustion engine according to the present invention satisfies the fundamental properties, such as plating adhesive properties, bending workability, of the spark plug electrode materials. Furthermore, the spark plug of an internal combustion engine according to the present invention greatly improves the heat resistance, such as the anti-fusion property, the high-temperature corrosion resistance, and the spark exhaustion durability. Furthermore, the spark plug of an internal combustion engine according to the present invention greatly improves the bonding reliability of a noble metal tip. Thus, it becomes possible to provide a spark plug for an internal combustion engine preferably applicable to an advanced engine (e.g., a direct fuel injection engine) which is subjected to a very severe thermal load environment not experienced by the conventional engine.

Hereinafter, a modified embodiment of the above-described second embodiment will be explained with reference to FIG. 10 or FIG. 11.

Figure 10A:
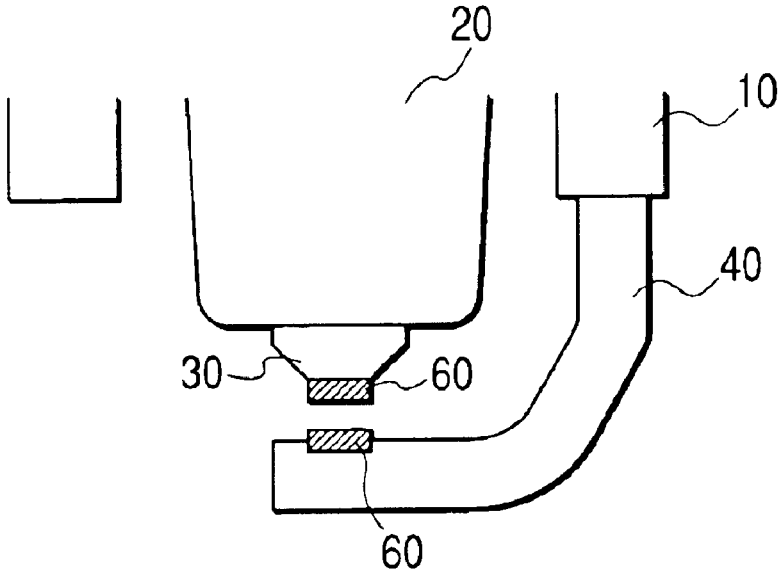
FIGS. 10A and 10B are typical cross-sectional views showing center and ground electrodes which are fixed by different welding methods in accordance with the present invention.
Figure 10B:
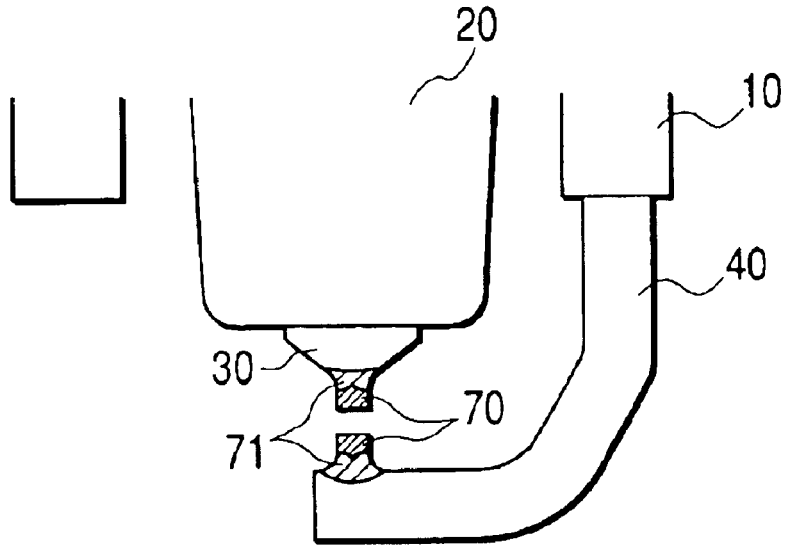
Figure 11A:
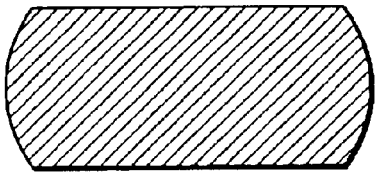
FIGS. 11A through 11D are typical cross-sectional views showing various shapes of the ground electrode in accordance with the present invention.
Figure 11B:
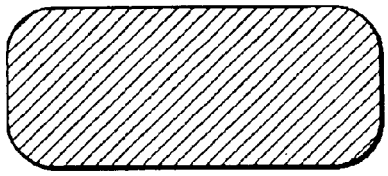
Figure 11C:
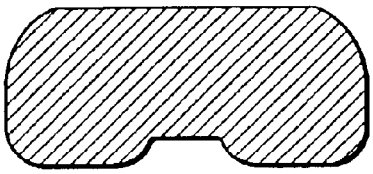
Figure 11D:
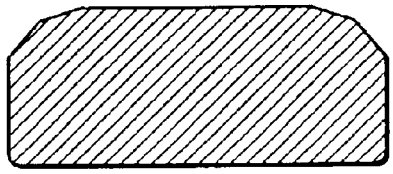

FIGS. 10A and 10B are typical cross-sectional views showing the center electrode and the ground electrode which are fixed by different welding methods. FIG. 10A shows Pt alloy tips 60 fixed to the center electrode 30 and the ground electrode 40 by resistance welding. FIG. 10B shows Ir alloy tips 70 fixed to the center electrode 30 and the ground electrode 40 via fused portions 71 by laser welding. In each case, it is possible to obtain the above-described effects of the present invention by using the electrode base materials having the composition defined by the first or second aspect of the present invention.

Furthermore, the ground electrode can be configured into various shapes as shown in FIGS. 11A to 11D without losing the above-described effects of the present invention when the ground electrode is made of the electrode base material having the composition defined by the first or second aspect of the present invention.

In each of the above-described embodiments, the Ni-base alloy is used as a material for forming the center electrode and the ground electrode of an engine spark plug. However, instead of using this material, it is also preferable to constitute at least one of the center electrode and the ground electrode by a base material which forms a surficial aluminum oxide when it is left in an atmospheric environment at a temperature equal to or larger than 950° C. for a duration equal to or longer than 50 hours.

When the spark plug satisfying the above-described conditions is used in the high-temperature environment exceeding 950° C., the surficial aluminum oxide is stably formed on the electrode base material. The surficial aluminum oxide effectively protects the inside portion of the electrode base material against oxidation. When a tip (i.e., a discharge member) is welded on the center electrode or the ground electrode serving as the electrode base material, the surficial aluminum oxide effectively protects the bonded boundary between the tip and the electrode base material against oxidation. Accordingly, it becomes possible to provide an excellent spark plug which is capable of preventing the electrode base material from abnormally oxidizing, preventing the tip from falling off the electrode base material due to oxidation in the bonded boundary, and assuring long-lasting high performance, even in a very severe thermal load environment.

Furthermore, when the surficial aluminum oxide is a continuously formed film having a thickness not larger than 30 $\mu$m, the surficial aluminum oxide is stably formed as an oxide coating layer densely covering the electrode base material. Thus, the surficial aluminum oxide surely prevents the oxygen ions from diffusing inside the electrode base material. The effect of suppressing the oxidation is further enhanced.

Furthermore, it is preferable that the tip is made of a Pt alloy including not less than 50 weight % Pt as a chief component and at least one additive component selected from the group consisting of Ir, Rh, Ni, W, Pd, Ru, Os, Y, and $Y_2O_3$. It is also preferable that the tip is made of an Ir alloy including not less than 50 weight % Ir as a chief component and at least one additive component selected from the group consisting of Pt, Rh, Ni, W, Pd, Ru, Os, Y, and $Y_2O_3$.

When the tip is made of the above-described material, it becomes possible to improve the spark exhaustion durability. Even when the tip is used in an engine subjected to a large thermal load, it is possible to assure a satisfactory life of the spark plug.

Figure 12A:
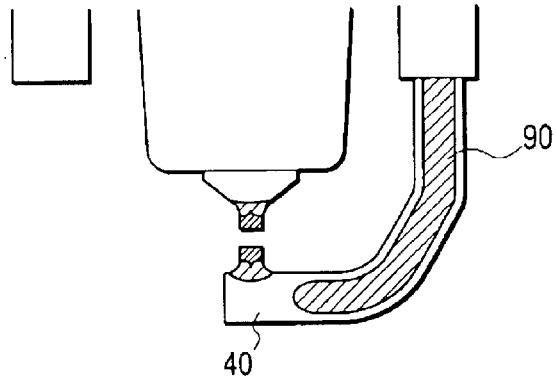
FIGS. 12A and 12B are typical cross-sectional views showing modified embodiments of the ground electrode in accordance with the present invention.
Figure 12B:
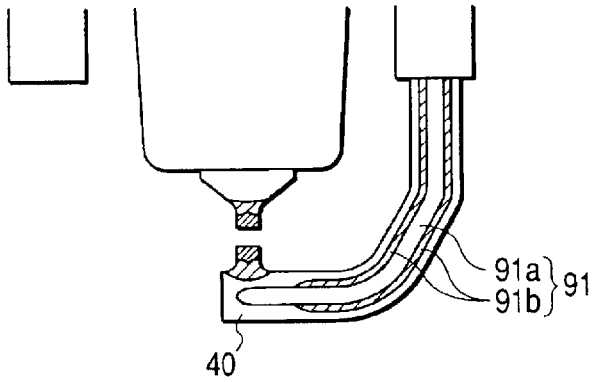

FIGS. 12A and 12B show modified arrangements of the ground electrode wherein an inner layer member 90 is provided inside the ground electrode. The inner layer member 90 has excellent thermal conductivity compared with the base material 40. The inner layer member 90 shown in FIG. 12A is a single Cu layer. The inner layer member 90 shown in FIG. 12B has a clad structure consisting of a core Cu layer 91*a* positioned at an inner portion and a Ni layer 91*b* surrounding the core Cu layer 91*a*. According to these arrangements, heat of the ground electrode is smoothly transferred to its base portion. Thus, it becomes possible to effectively lower the electrode temperature. The heat resistance can be further improved.

Figure 13:
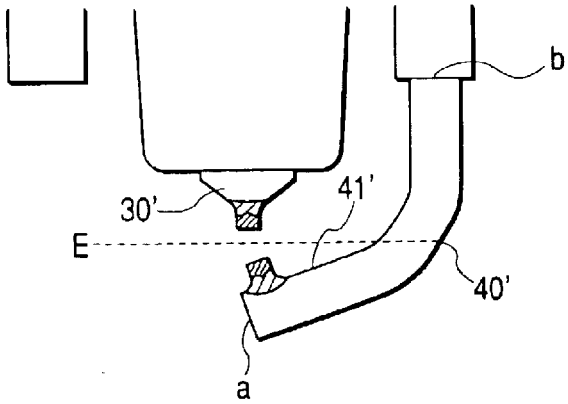
FIG. 13 is a typical cross-sectional view showing another modified embodiment of the ground electrode in accordance with the present invention.

FIG. 13 shows another modified arrangement of the ground electrode. As shown in FIG. 13, a ground electrode 40' has a distal end surface 41' opposing a center electrode 30'. The distal end surface 41' is inclined with respect to a surface 'E' normal to the axial direction of the center electrode 30'. According to this arrangement, an entire length (i.e., a distance from 'a' to 'b' shown in FIG. 13) of ground electrode 40' is short compared with that of an ordinary ground electrode (whose distal end surface is parallel to the surface 'E'). This is effective to smoothly transfer the heat of ground electrode to its base portion (indicated by 'b' in FIG. 13). The heat resistance can be further improved.

According to the present invention, it is possible to adequately combine the above-described modified embodiments into a practical form.

Besides an automotive engine, the engine spark plug according to the present invention can be applied to a motorcycle engine, a marine engine, or a stationary engine.

As described above, the spark plug for an internal combustion engine in accordance with the present invention is characterized in that at least one of the center electrode and the ground electrode is a Ni-base alloy containing, in weight percentage, 0.5~2.5% Si, 0.1~1.2% Mn, 3.2~5.0% Al, 0.9~2.8% Cr, 0.001~0.025% C in addition to Ni and unavoidable impurities. Accordingly, it becomes possible to provide a spark plug which satisfies the fundamental performances required for an internal combustion engine spark plug and assures reliable heat resistance even in a severe combustion atmosphere exceeding 950° C. in electrode temperature. Furthermore, when the ratio S/V of the surface area 'S' to the volume 'V' of the ground electrode is in the range from 1.7 $mm^{-1}$ to 3.9 $mm^{-1}$, not only the heat resistance can be assured in the combustion atmosphere exceeding 950° C. in electrode temperature but also the bending work of the ground electrode can be facilitated.

In the above-described engine spark plug, it is preferable that at least one of the center electrode and the ground electrode is a Ni-base alloy containing, in weight percentage, 1.0~2.5% Si, 0.1~0.9% Mn, 3.5~5.0% Al, 1.3~2.5% Cr, 0.001~0.025% C in addition to Ni and unavoidable impurities. When the electrode material has the above-described composition, it becomes possible to provide a spark plug which satisfies the fundamental performances required for an internal combustion engine spark plug and assures excellent heat resistance even in a severer combustion atmosphere exceeding 1,050° C. in electrode temperature.

Furthermore, in the above-described engine spark plug, it is further preferable that the ratio S/V of the ground electrode is in the range from 1.7 $mm^{-1}$ to 3.0 $mm^{-1}$, not only the heat resistance can be assured in the combustion atmosphere exceeding 1,050° C. in electrode temperature but also the bending work of the ground electrode can be facilitated.

The present invention provides a spark plug for an internal combustion engine comprising an insulator, a center electrode fixed to a leg portion of the insulator which is exposed to a combustion chamber of an internal combustion engine, a metal housing firmly surrounding an outer surface of the insulator, and a ground electrode fixed to an end of the metal housing so as to form a spark discharge gap between the center electrode and the ground electrode. And, at least one of the center electrode and the ground electrode is constituted by a base material which forms a surficial aluminum oxide when it is left in an atmospheric environment at a temperature equal to or higher than 950° C. for a duration equal to or longer than 50 hours.

When the spark plug of this invention is used in the high-temperature environment exceeding 950° C., the surficial aluminum oxide is stably formed on the electrode base material. The surficial aluminum oxide effectively protects the inside portion of the electrode base material against oxidation. When a tip (i.e., a discharge member) is welded on the center electrode or the ground electrode serving as the electrode base material, the surficial aluminum oxide effectively protects the bonded boundary between the tip and the electrode base material against oxidation. Accordingly, the present invention provides an excellent spark plug which is capable of preventing the electrode base material from abnormally oxidizing, preventing the tip from falling off the electrode base material due to oxidation in the bonded boundary, and assuring long-lasting high performance, even in a very severe thermal load environment.

Furthermore, when the surficial aluminum oxide is a continuously formed film having a thickness not larger than 30 $\mu$m, the surficial aluminum oxide is stably formed as an oxide coating layer densely covering the electrode base material. Thus, the surficial aluminum oxide surely prevents the oxygen ions from diffusing inside the electrode base material. The effect of suppressing the oxidation is further enhanced.

According to the present invention, it is preferable that a portion of the ground electrode having not been subjected to bending deformation has a hardness Hv (0.5) equal to or less than 210 when the hardness is measured with a testing force of 4.903N according to a micro Vickers' hardness testing method regulated in JIS standard Z2244. In general, adding Al in the electrode base material worsens the bending workability due to increase of hardness. However, when the hardness Hv (0.5) of the ground electrode is equal to or less than 210, it becomes possible to adequately suppress the springback into a practically allowable range when the ground electrode is subjected to bending deformation to form a discharge gap. Accordingly, the discharge gap can be accurately formed.

When the hardness Hv(0.5) of the ground electrode is equal to or smaller than 190, the bending workability is further improved. The discharge gap can be adjusted further accurately.

Furthermore, in the above-described engine spark plug, when at least one of the center electrode and the ground electrode serves as a base material, it is possible to fixe a tip, being made of a noble metal or its alloy, to a surface of the base material by welding. Not only the spark exhaustion durability can be greatly improved but also the bonding reliability of the noble metal tip welded to the electrode material can be greatly improved. Accordingly, it becomes possible to provides a spark plug having excellent heat resistance as well as excellent spark exhaustion durability and bonding reliability even in a very severe thermal load environment.

Furthermore, in the above-described engine spark plug, it is preferable that the tip is made of a Pt alloy including not less than 50 weight % Pt as a chief component and at least one additive component selected from the group consisting of Ir, Rh, Ni, W, Pd, Ru, Os, Y, and $Y_2O_3$. It is also preferable that the tip is made of an Ir alloy including not less than 50 weight % Ir as a chief component and at least one additive component selected from the group consisting of Pt, Rh, Ni, W, Pd, Ru, Os, Y, and $Y_2O_3$. When the tip is made of the above-described material, it becomes possible to improve the spark exhaustion durability. Even when the tip is used in an engine subjected to a large thermal load, it is possible to assure a satisfactory life of the spark plug.

Furthermore, in the above-described engine spark plug, it is preferable that the ground electrode has a plated layer formed on a surface thereof. The plated layer improves the high-temperature and high-humid durability of a spark plug before the spark plug is installed in an internal combustion engine. Furthermore, the plated layer improves the appearance and the commercial value of a spark plug. When the spark plug is installed in the internal combustion engine, the effects and functions of the above-described electrode materials can be sufficiently obtained from the beginning of its operation.

Besides an automotive engine, the engine spark plug of the present invention can be applied to a motorcycle engine, a marine engine, or a stationary engine.

What is claimed is:

1. A spark plug for an internal combustion engine comprising:

an insulator;

a center electrode fixed to a leg portion of said insulator which is exposed to a combustion chamber of an internal combustion engine;

a metal housing firmly surrounding an outer surface of said insulator; and a ground electrode fixed to an end of said metal housing so as to form a spark discharge gap between said center electrode and said ground electrode, wherein at least one of said center electrode and said ground electrode is a Ni-base alloy containing, in weight percentage, 0.5~2.5% Si, 0.1~1.2% Mn, 3.2~5.0% Al, 0.9~2.8% Cr, 0.001~0.025% C in addition to Ni and unavoidable impurities, and a value S/V is in a range from 1.7 $mm^{-1}$ to 3.9 $mm^{-1}$ when 'S' represents a surface area of said ground electrode and 'V' represents a volume of said ground electrode.

2. The spark plug for an internal combustion engine in accordance with claim 1, wherein at least one of said center electrode and said ground electrode is a Ni-base alloy containing, in weight percentage, 1.0~2.5% Si, 0.1~0.9% Mn, 3.5~5.0% Al, 1.3~2.5% Cr, 0.001~0.025% C in addition to Ni and unavoidable impurities.

3. The spark plug for an internal combustion engine in accordance with claim 1, wherein said S/V is in a range from 1.7 $mm^{-1}$ to 3.0 $mm^{-1}$.

4. The spark plug for an internal combustion engine in accordance with claim 1, wherein a portion of said ground electrode having not been subjected to bending deformation has a hardness Hv (0.5) equal to or less than 210 when the hardness is measured with a testing force of 4.903N according to a micro Vickers' hardness testing method regulated in JIS standard Z2244.

5. The spark plug for an internal combustion engine in accordance with claim 1, wherein a portion of said ground electrode having not been subjected to bending deformation has a hardness Hv (0.5) equal to or less than 190 when the hardness is measured with a testing force of 4.903N according to a micro Vickers' hardness testing method regulated in JIS standard Z2244.

6. The spark plug for an internal combustion engine in accordance with claim 1, wherein at least one of said center electrode and said round electrode serves as a base material, and a tip is fixed to a surface of said base material by welding, said tip being made of a noble metal or its alloy.

7. The spark plug for an internal combustion engine in accordance with claim 6, wherein said tip is made of a Pt alloy including not less than 50 weight % Pt as a chief component and at least one additive component selected from the group consisting of Ir, Rh, Ni, W, Pd, Ru, Os, Y, and $Y_2O_3$.

8. The spark plug for an internal combustion engine in accordance with claim 6, wherein said tip is made of an Ir alloy including not less than 50 weight % Ir as a chief component and at least one additive component selected from the group consisting of Pt, Rh, Ni, W, Pd, Ru, Os, Y, and $Y_2O_3$.

9. The spark plug for an internal combustion engine in accordance with claim 1, wherein said ground electrode has a plated layer formed on a surface thereof.

10. The spark plug for an internal combustion engine in accordance with claim 1, wherein at least one of said center electrode and said ground electrode is constituted by a base material which forms a surficial aluminum oxide when it is left in an atmospheric environment at a temperature equal to or higher than 950° C. for a duration equal to or longer than 50 hours.

11. The spark plug for an internal combustion engine in accordance with claim 10, wherein said surficial aluminum oxide is a continuously formed film having a thickness not larger than 30 $\mu$m.

12. The spark plug for an internal combustion engine in accordance with claim 10, wherein a portion of said ground electrode having not been subjected to bending deformation has a hardness Hv (0.5) equal to or less than 210 when the hardness is measured with a testing force of 4.903N according to a micro Vickers' hardness testing method regulated in JIS standard Z2244.

13. The spark plug for an internal combustion engine in accordance with claim 10, wherein a portion of said ground electrode having not been subjected to bending deformation has a hardness Hv (0.5) equal to or less than 190 when the hardness is measured with a testing force of 4.903N according to a micro Vickers' hardness testing method regulated in JIS standard Z2244.

14. The spark plug for an internal combustion engine in accordance with claim 10, wherein at least one of said center electrode and said ground electrode serves as a base material, and a tip is fixed to a surface of said base material by welding, said tip being made of a noble metal or its alloy.

15. The spark plug for an internal combustion engine in accordance with claim 14, wherein said tip is made of a Pt alloy including not less than 50 weight % Pt as a chief component and at least one additive component selected from the group consisting of Ir, Rh, Ni, W, Pd, Ru, Os, Y, and $Y_2O_3$.

16. The spark plug for an internal combustion engine in accordance with claim 14, wherein said tip is made of an Ir alloy including not less than 50 weight % Ir as a chief component and at least one additive component selected from the group consisting of Pt, Rh, Ni, W, Pd, Ru, Os, Y, and $Y_2O_3$.

17. The spark plug for an internal combustion engine in accordance with claim 10, wherein said ground electrode has a plated layer formed on a surface thereof.

* * * * *